US008652423B2

(12) United States Patent
Shick

(10) Patent No.: US 8,652,423 B2
(45) Date of Patent: Feb. 18, 2014

(54) VIAL CLOSURE WITH SEPTUM RETENTION FEATURE

(75) Inventor: Leemen Loy Shick, Duluth, GA (US)

(73) Assignee: National Scientific Company, Rockwood, TN (US)

( * ) Notice: Subject to any disclaimer, the term of this patent is extended or adjusted under 35 U.S.C. 154(b) by 0 days.

(21) Appl. No.: 13/562,654

(22) Filed: Jul. 31, 2012

(65) Prior Publication Data

US 2013/0058845 A1 Mar. 7, 2013

Related U.S. Application Data

(63) Continuation-in-part of application No. 13/225,587, filed on Sep. 6, 2011.

(51) Int. Cl.
*B01L 3/14* (2006.01)

(52) U.S. Cl.
USPC ..... 422/550; 422/547; 422/549; 215/247; 215/321

(58) Field of Classification Search
USPC ..... 422/547, 548, 549, 550; 215/247, 316, 215/320, 321; 604/415
See application file for complete search history.

(56) References Cited

U.S. PATENT DOCUMENTS

| | | | | |
|---|---|---|---|---|
| 4,519,518 | A | 5/1985 | Wiles et al. | |
| 4,557,394 | A | 12/1985 | Luker | |
| 5,133,471 | A | 7/1992 | Pujol Almirall | |
| 5,871,111 | A | 2/1999 | Pfefferkorn et al. | |
| 7,168,581 | B2 * | 1/2007 | Robinson et al. | 215/349 |
| 7,527,161 | B2 | 5/2009 | Rodriguez et al. | |
| 2004/0131506 | A1 * | 7/2004 | Zurcher | 422/102 |

FOREIGN PATENT DOCUMENTS

| | | | |
|---|---|---|---|
| EP | 0 747 293 | A1 | 12/1996 |
| FR | 2 937 309 | A1 | 4/2010 |
| WO | 93/01098 | A2 | 1/1993 |

OTHER PUBLICATIONS

Thermo Fisher Scientific Inc., Drawing entitled Chemie-Verschluss DIN 45, dated Jan. 26, 2005 (1 page).
Thermo Fisher Scientific Inc., Drawing entitled Zusammenstellung Verschluss DIN 45, dated Jul. 27, 2004 (1 page).
Thermo Fisher Scientific Inc., Drawing entitled Schraubverschluss mit Originalitaet "zu Chemie-Verschluss", dated Jan. 19, 2005 (1 page).
Thermo Fisher Scientific Inc., Drawing entitled Chemieflasche 100 ml, dated Feb. 14, 2005 (1 page).
Thermo Fisher Scientific Inc., Drawing entitled Spezialmundung 45 mm, dated Mar. 13, 2007 (1 page).

(Continued)

*Primary Examiner* — Jill Warden
*Assistant Examiner* — Dwayne K Handy
(74) *Attorney, Agent, or Firm* — Wood, Herron & Evans, LLP

(57) ABSTRACT

A vial and closure assembly including a vial and a closure configured to be threadably coupled to the vial. The vial has an opening end that is defined by a vial rim and at least one thread located proximate to the open end of the vial. The closure includes a top wall with a skirt wall depending from the top wall. A septum pocket is provided in the top wall and is configured to receive a septum positioned therein. A protrusion depends from the top wall, extends into the septum pocket, and is configured to engage the septum so that the septum creates an essentially vapor-tight seal with the vial rim when the closure is threadably coupled to the vial.

15 Claims, 8 Drawing Sheets

(56) References Cited

OTHER PUBLICATIONS

International Searching Authority, International Search Report and Written Opinion of the International Searching Authority, International Application No. PCT/US13/52289, mailed on Aug. 26, 2013 (12 pages).

ESPACENET, English Machine Translation of Application No. FR2937309A1, retrieved from http://worldwide.espacenet.com on Apr. 19, 2013 (10 pages).

European Patent Office, International Search Report and Written Opinion of the International Searching Authority, International Application No. PCT/US2012/051075, mailed on Nov. 9, 2012 (11 pages).

* cited by examiner

VIAL CLOSURE WITH SEPTUM RETENTION FEATURE

The present application is a continuation-in-part of co-pending U.S. application Ser. No. 13/225,587, filed on Sep. 6, 2011, the disclosure of which is hereby incorporated by reference in its entirety.

FIELD OF THE INVENTION

The present invention relates generally to vial and closure assemblies and, more particularly, to a vial closure having a piercable septum or liner.

BACKGROUND OF THE INVENTION

Screw thread vials and closures are commonly used in laboratory applications for which effective sealing with near zero evaporation is important. When using conventional vial and closure assemblies, a user must be careful to apply a correct amount of torque when securing the closure to the vial. If a user fails to apply the correct amount of torque, then the assembly may fail to perform properly due to a non-uniform seal formed between the vial and closure. That is, fluids and/or vapors may escape from the vial via spillage and/or evaporation when a vapor-tight seal is not initially created or maintained.

Gas chromatography and high performance liquid chromatography applications are examples of laboratory techniques for which vapor-tight vial and closure assemblies are essential. The closures of chromatography vials often comprise a closure fitted with a piercable septum. When the closure is tightened onto the vial, the septum is compressed between the top wall of the closure and the rim of the vial to provide an essentially vapor-tight compression seal. Chromatography vials are often very small, such as 9 mm or 12 mm for example, and are typically constructed of glass or plastic.

Most solvents used in chromatography have a low vaporization point. It is important to have an effective compression seal against evaporation of the solvents used in gas chromatography and in high performance liquid chromatography applications. Particularly due to the small size of chromatography vials, it is oftentimes difficult to apply a consistent amount of torque to a plurality of closure and vial assemblies, i.e., from one to the next, particularly when multiple operators are handling the plurality of assemblies. If a closure is tilted in relation to the vial, a non-uniform or ineffective seal may occur with the vial rim that permits solvent evaporation. Even small amounts of evaporation may greatly affect the concentration of one or more solutes in the low volumes of solvent contained within the small vials. Moreover, tilting of the closure may complicate handling of the vial by robotic handling systems used in conventional autosamplers which are generally designed for a vial that has a cylindrical shape.

Another common problem with conventional chromatography vials provided with closures having piercable septums is that over-tightening of the closure with respect to the vial may result in at least a partial extrusion of the septum away from the sealing surfaces. This further reduces the likelihood of creating an effective fluid and vapor tight seal.

Vial and closure assemblies used for chromatography must also be capable of fully resealing after the septum is initially punctured. That is, when a needle penetrates and is withdrawn from the septum, the septum must resist being pushed through or being withdrawn from the cap. Such extrusion or withdrawal causes the seals to fail, increases the loss of solvent through evaporation and, thus, renders inaccurate results in chromatography applications using these vials of solvents.

Furthermore, over-torquing the closure with respect to the vial may create non-uniform, radial tension on the septum so that the septum does not present a generally planar piercing surface. This increases the risk of septum coring and/or needle bending in chromatography or autosampler instruments.

Because conventional vial and closure assemblies have not provided satisfactory solutions to the problems associated with creating an effectively vapor-tight seal, there remains a need for a vial and closure assembly that is capable of forming a vapor-tight seal, even while resisting an application of excessive torque or non-uniform seal between the vial and the closure, particularly for small vials.

SUMMARY OF THE INVENTION

The present invention overcomes the foregoing problems and other shortcomings and drawbacks of known vial and closure assemblies. While the present invention will be described in connection with certain embodiments, it will be understood that the present invention is not limited to these embodiments. To the contrary, this invention includes all alternatives, modifications, and equivalents as may be included within the spirit and scope of the present invention.

According to one embodiment of the present invention, a vial and closure assembly includes a vial and a closure configured to be threadably coupled to the vial. The vial has an opening end that is defined by a vial rim and at least one thread located proximate to the open end of the vial. The closure includes a top wall with a skirt wall depending from the top wall. A septum pocket is provided in the top wall and is configured to receive a septum positioned therein. A protrusion depends from the top wall, extends into the septum pocket, and is configured to engage the septum so that the septum creates an essentially vapor-tight seal with the vial rim.

According to one aspect of the present invention, the protrusion has an inner surface and an outer surface that are asymmetric relative to a vertical plane extending through a peak of the protrusion.

According to another aspect of the present invention, the protrusion is further configured to stretch the septum, relative to the vial rim, such that the septum is secured and immobilized with regard to the vial rim.

The closure is configured to be received by the open vial and comprises, in one embodiment, a top wall, a skirt wall having an inner surface and depending from the top wall, an inner thread provided on the inner surface of the skirt wall. A septum pocket is provided in the top wall and is configured to receive a septum positioned therein. A protrusion depends from the top wall, extends into the septum pocket, and is configured to engage the septum so that the septum creates an effectively vapor-tight seal with the vial rim. The protrusion has an inner surface and an outer surface that are asymmetric relative to a vertical plane extending through a peak of the protrusion.

The above and other objectives of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

DETAILED DESCRIPTION OF THE INVENTION

Figure 1:
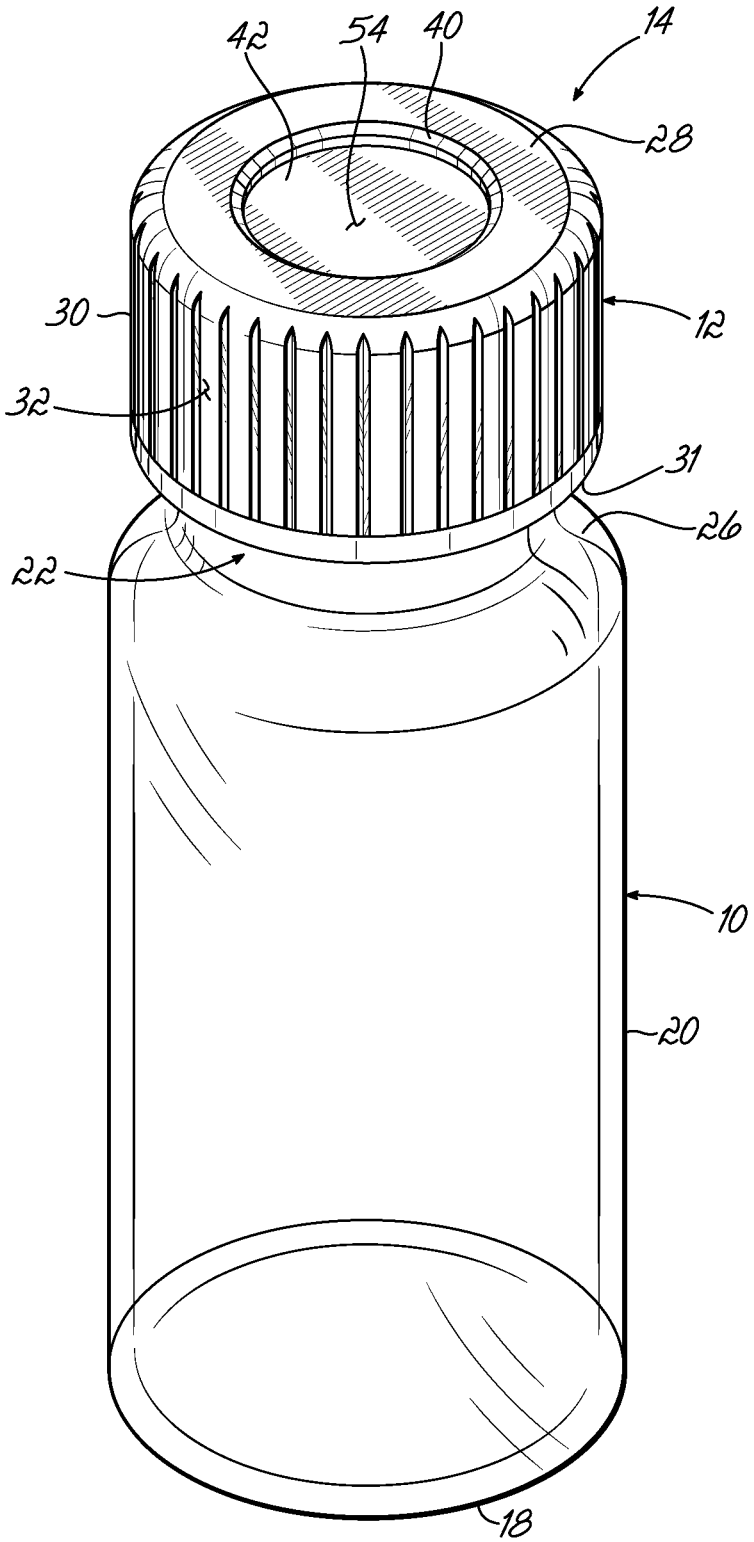
FIG. 1 is a perspective view of a vial and closure assembly in accordance with one embodiment of the present invention.
Figure 2:
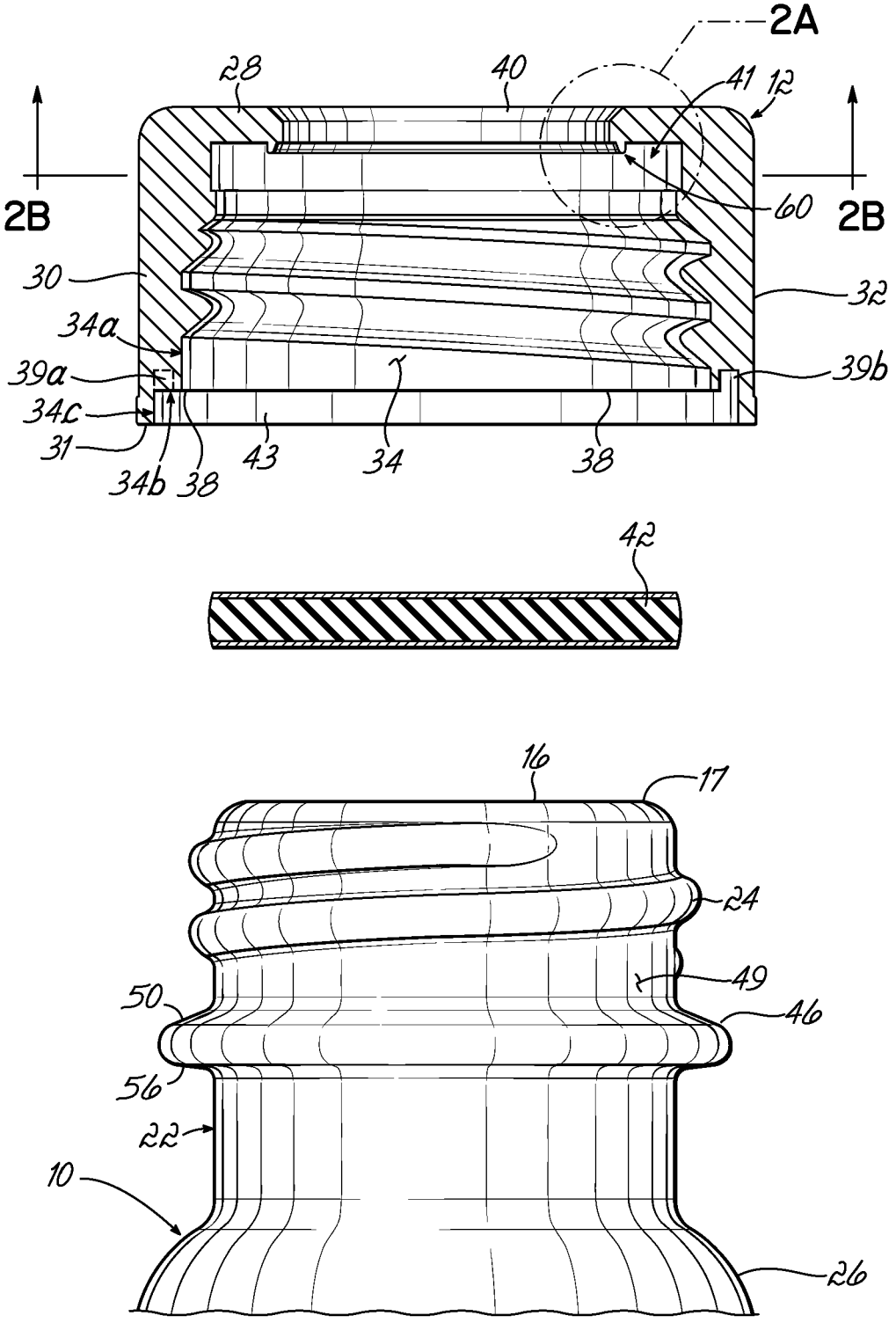
FIG. 2 is a side-elevational view of vial and closure assembly of FIG. 1, showing the vial and closure disassembled.

Turning now to the figures, and in particular to FIGS. 1 and 2, a vial 10 and a closure 12, collectively referred to as a vial and closure assembly 14, are shown according to one embodiment of the present invention. The vial 10 and the closure 12 may be configured as a labware product, such as a 2 mL chromatography vial for example, for use with manual or automatic (including robotic) analytical instruments.

In one embodiment, the vial 10 is comprised of a hollow structure for the containment of a fluid and/or vapor and includes an open end 16 defined by a vial rim 17 (FIGS. 4 and 5) and a closed end 18. The open end 16 of the vial 10 may be generally circular and the hollow structure of the vial 10 may be constructed of glass, plastic, or other suitable material that is inert with respect to the fluid contained therein.

An outer surface of the vial 10 proximate the open end 16 (FIG. 3) may include at least one outer thread 24 (FIGS. 2-5) comprising, for example, an 8-425 thread, a 9-425 or 9 mm thread, a 10-425 thread, or any other suitable thread configuration that is configured to threadably couple with the closure 12. In the illustrated embodiment of FIGS. 2-5, the outer thread 24 of the vial 10 is a single thread. It will be readily appreciated that, in other embodiments, a series of multiple outer threads 24 may be used in place of a single, continuous outer thread 24. The outer thread 24 may further comprise a single turn or multiple turns of the vial 10. In one embodiment, the thread 24 comprises a 1½ turn. As shown, the outer thread 24 is located on a neck 22 and extends down at least a portion of the neck 22. In this way, when the closure 12 is fully secured onto the vial 10, an uncovered portion 44 (FIG. 5) of the neck 22 remains.

Figure 3:
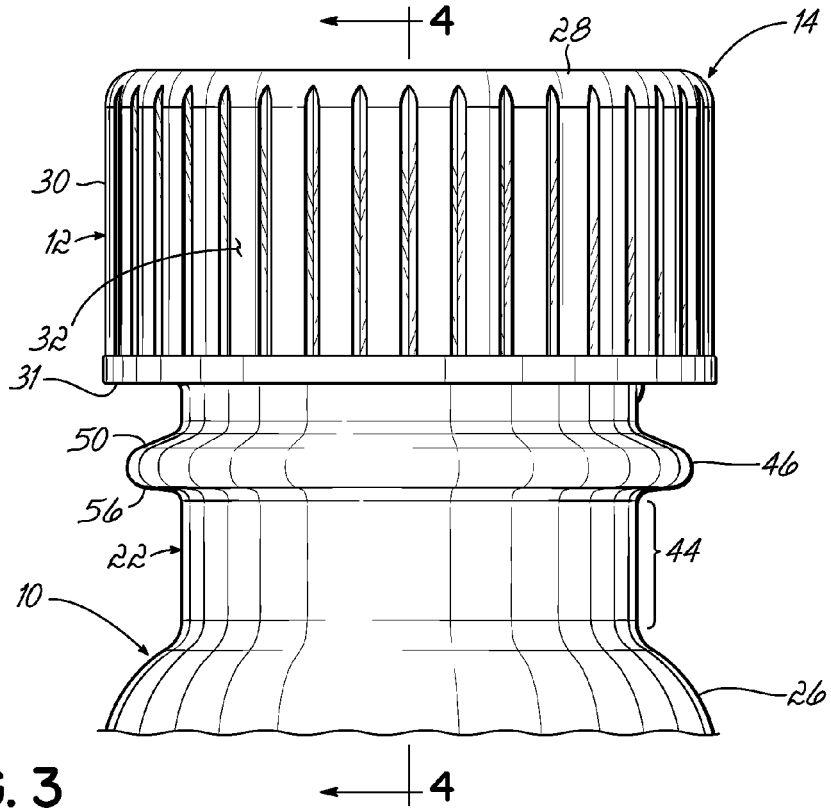
FIG. 3 is a side-elevational view of the vial and closure assembly of FIG. 1 in an assembled but non-fully torqued position.

Referring now to FIGS. 1-3, in some embodiments, such as the particular illustrative vial 10, the hollow structure of the vial 10 may include a body portion 20 and the neck 22 which extends substantially downward from the open end 16 of the vial 10. The neck 22 has an outer diameter that is generally smaller than an outer diameter of the body portion 20.

The vial 10 may also include a shoulder 26 at a base of the neck 22. The shoulder 26 forms a transition between the neck 22 and the body portion 20 and, therefore, may have an outer diameter that increases between the smaller, outer diameter of the neck 22 and the larger, outer diameter of the body portion 20. One particular advantage of the illustrative vial shape, including the neck 22 and shoulder 26, is that the shape facilitates manipulation by robotics, such as robotic chromatographs, autosamplers, and other laboratory instrumentation, as described in detail below.

Referring still to FIGS. 1 and 2, the closure 12 is constructed so as to be received by the open end 16 of the vial 10. The closure 12 has a top wall 28 and a skirt wall 30 that depends from the top wall 28. The skirt wall 30 terminates in a rim 31 that is located opposite the top wall 28. An outer surface 32 of the skirt wall 30 may have ridges or another textured surface to facilitate gripping of the closure 12 for turning of the closure 12 relative to the vial 10. An inner surface 34 of the skirt wall 30 of the closure 12 may have a portion 34*a* (FIG. 2) that is generally circular in cross section and has a diameter that is slightly larger than the outer diameter of the open end 16 of the vial 10. The skirt wall 30 of the closure 12 includes at least one inner thread 36 (FIG. 4) provided on the inner surface portion 34*a* that is configured to threadably cooperate with the outer thread 24 (FIG. 4) provided on the vial 10.

Figure 4:
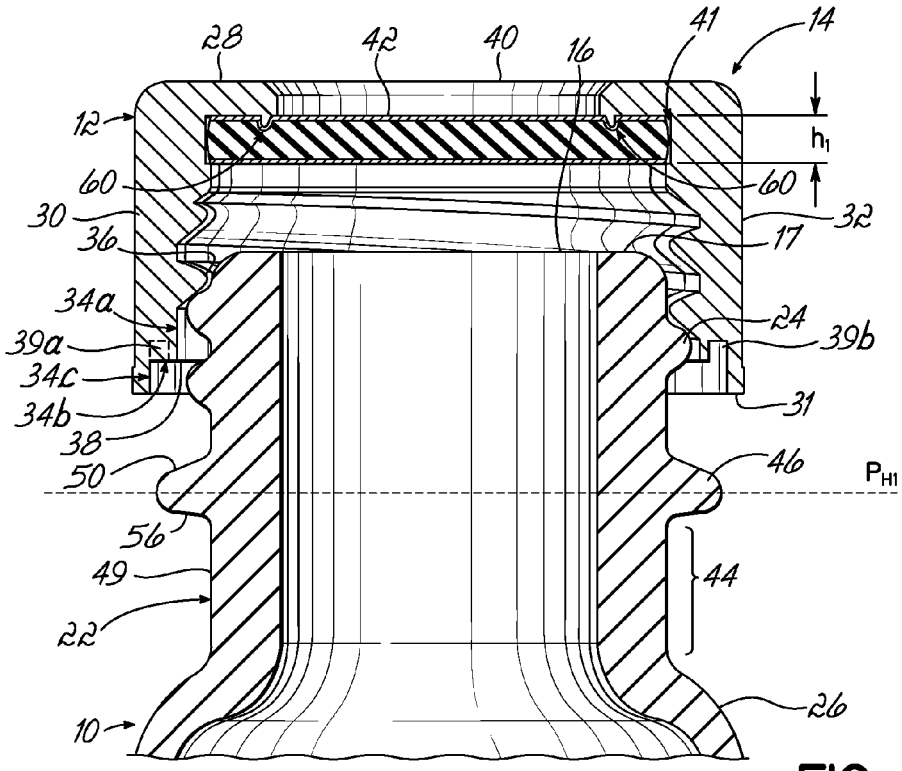
FIG. 4 is a cross-sectional view taken along the line 4-4 of FIG. 3.
Figure 9:
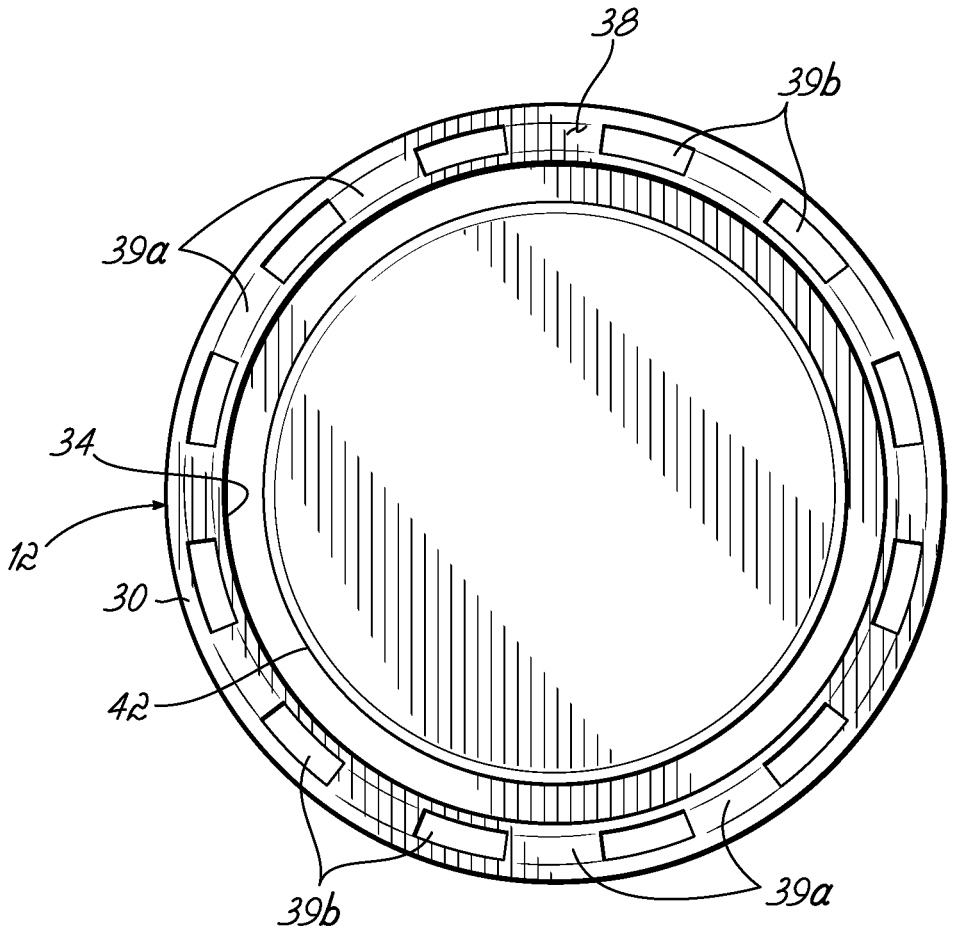
FIG. 9 is a bottom view of the closure shown in FIG. 1, with an inner thread of the closure removed for clarity.

Although not required, the skirt wall 30 of the illustrative embodiment of the present invention further includes a stop surface 38 (FIGS. 2, 4 and 5) provided on a portion 34*b* (FIGS. 2 and 4) of the inner surface 34 of the skirt wall 30 such that the inner thread 36 is located between the stop surface 38 and the top wall 28 of the closure 12. In one embodiment, the stop surface 38 is integrally formed in the skirt wall 30 and is formed generally as a plurality of discrete, circumferentially spaced ledges 39*a* that are separated by a plurality of discrete, circumferentially spaced cavities 39*b* as shown in FIGS. 2, 4 and 9. The stop surface 38 forms a radially expanding transition between the portion 34*a* of the inner surface 34 of the skirt wall and a cylindrical surface 43 (FIG. 2) provided on a portion 34*c* (FIG. 2) of the inner surface 34 that has a diameter greater than the diameter of the inner surface portion 34*a* of the skirt wall 30 and extends from the stop surface 38 to the rim 31.

In the illustrative embodiment, the closure 12 includes an opening 40 formed through the top wall 28 and a septum pocket 41 (FIGS. 2, 4 and 5) communicating with the opening 40. The septum pocket 41 is configured to receive and retain a compressible septum 42 so that the septum 42 is at least partially exposed through the opening 40.

Figure 2A:
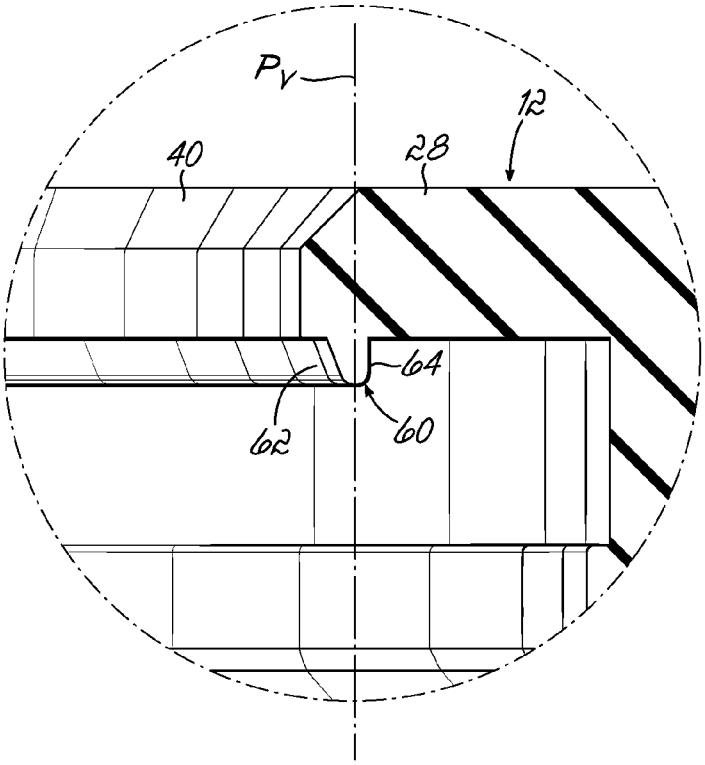
FIG. 2A is an enlarged view of a portion of the closure encircled 2A in FIG. 2.
Figure 2B:
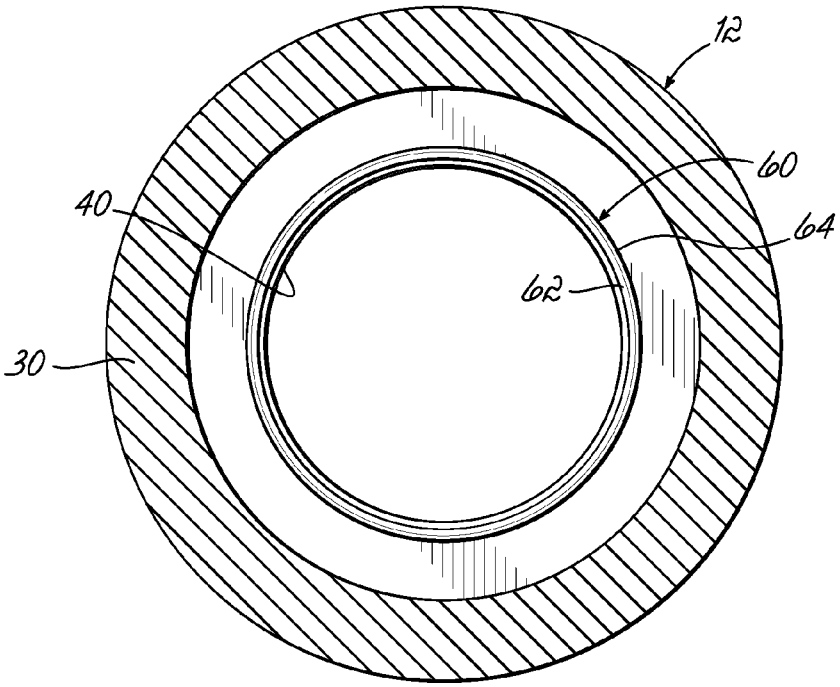
FIG. 2B is a cross-sectional view of the closure as shown in FIG. 2, taken along the line 2B-2B, illustrating a protrusion configured to engage a septum so that the septum creates a fluid and vapor tight seal with the vial rim according to one embodiment of the present invention.
Figure 2C:
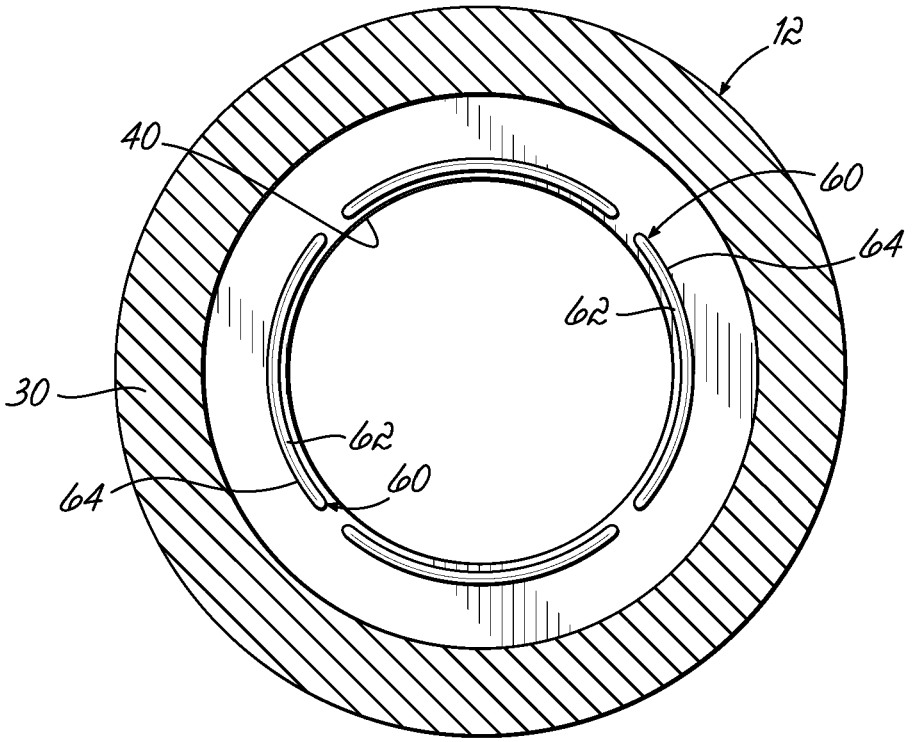
FIG. 2C is a cross-sectional view of a closure having a protrusion configured to engage a septum so that the septum creates a fluid and vapor tight seal with the vial rim in accordance with another embodiment of the present invention.

A protrusion 60 depends from the top wall 28, is spaced radially outwardly from the opening 40, and extends into the septum pocket 41. The protrusion 60 may be continuous, forming a circumferential ring about the opening 40 (as shown in FIG. 2B), or discontinuous, being constructed as a plurality of lugs (as shown in FIG. 2C). The protrusion 60 may have a sharp edge profile (including, for example, a triangular or acute angle curve) that is configured to engage the septum 42 when the vial 10 and the closure 12 are full assembled. In that regard, the edge profile may have inner and outer surfaces that are symmetric with respect to a vertical plane ($P_v$) extending through a peak of the protrusion 60 or, as shown in FIG. 2A, the inner surface 62 may form a larger angle with respect to the vertical plane $P_v$ while the outer surface 64 forms a smaller angle with respect to $P_v$, i.e., the outer surface is more vertical. In this alternative embodiment, the inner and outer surfaces 62, 64 may be asymmetric relative to the vertical plane $P_v$ extending through the peak of the protrusion 60, when viewed in cross-section as shown in FIG. 2A.

When the vial 10 and the closure 12 are fully assembled, the septum 42 is compressed between the vial rim 17 and the top wall 28, generally, and with further compression between the vial rim 17 and the protrusion 60. This further compression causes the protrusion to engage the septum 42 so as to create an essentially fluid and vapor tight seal between the septum 42 and the vial rim 17 and to minimize evaporation of solvents from within the vial. In some instances, the septum 42 may be stretched over the vial rim 17 by the protrusion 60 to resist movement of the septum 42, even under excessive torque.

In an alternative embodiment (not shown), the closure 12 has a closed top without the opening 40 formed through the top wall 28. Rather than a septum 42, a conventional liner (not shown) may be provided between the top wall 28 of the closure 12 and the vial rim 17. When the vial 10 and the closure 12 are fully assembled, the liner (not shown) is compressed between the vial rim 17 and the top wall 28 of the closure 12 so that the liner (not shown) engages and creates a fluid and vapor tight seal with the vial rim.

In accordance with another aspect of the present invention, and as shown in FIGS. 2-5, the neck 22 of the vial 10 includes an outwardly projecting rib 46 which extends circumferentially around the neck 22 in one embodiment.

Figure 5:
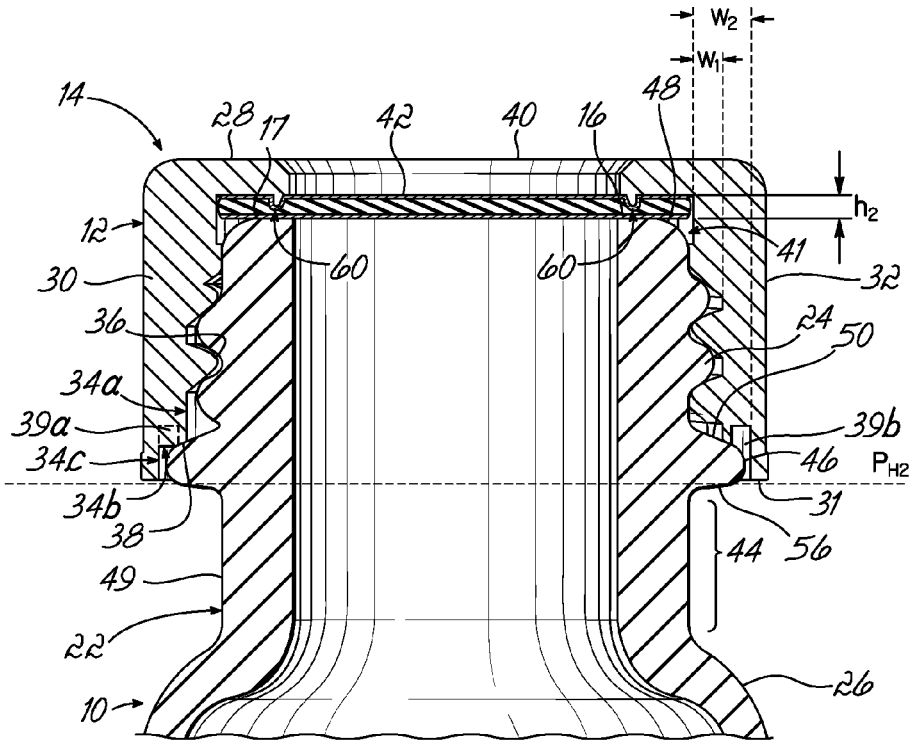
FIG. 5 is a view similar to FIG. 4 showing the vial and closure assembly in a fully torqued position.
Figure 8:
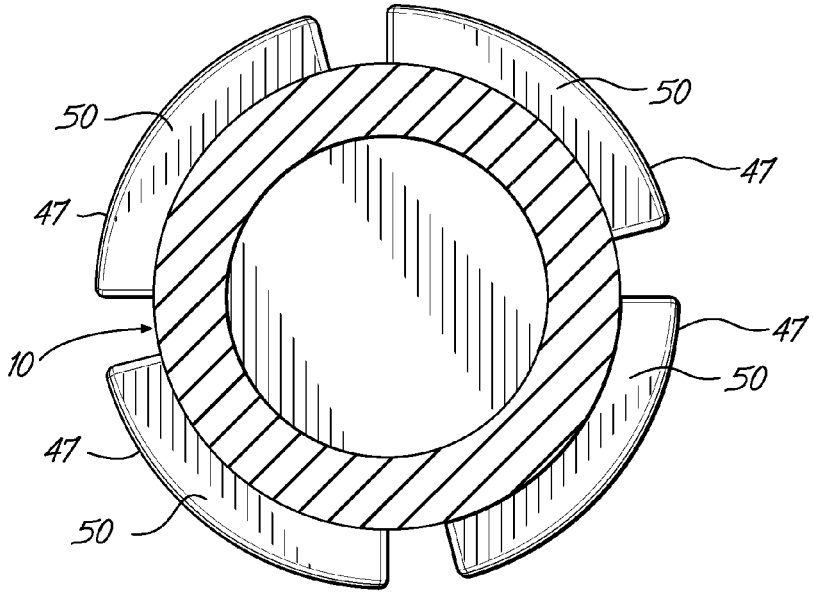
FIG. 8 is a cross-sectional view of a vial according to another aspect of the present invention having a discontinuous outwardly projecting rib.

The outwardly projecting rib 46 may be either a single continuous rib, as shown in FIGS. 2-5, or one or more discontinuous ribs 47 as shown in the alternative embodiment of FIG. 8. As shown in FIG. 5, the outer thread 24 and the outwardly projecting rib 46 have respective maximum width dimensions "$W_1$" and "$W_2$" with respect to an outer surface 49 of the neck 22, with the maximum width dimension "$W_2$" being greater than the maximum width dimension "$W_1$." The outwardly projecting rib 46 lies in a generally horizontal plane "$P_{H1}$" (FIG. 4) that is parallel to the vial rim 17 and may be constructed from the same material as the vial 10, e.g., a bead of glass formed on a glass vial or a bead of plastic formed on a plastic vial. In one embodiment, the outwardly projecting rib 46 is asymmetrical, when viewed in cross section, relative to the generally horizontal plane "$P_{H1}$" extending through the maximum width dimension "$W_2$" of the outwardly projecting rib 46 as shown in FIG. 4. In the embodiment shown in FIGS. 2-5, the outwardly projecting rib 46 is located on the neck 22 above the shoulder 26 of the vial 10. Accordingly, when the closure 12 is fully secured to the vial 10, the uncovered portion 44 of the neck 22 remains.

The outwardly projecting rib 46 creates a stop surface 50 (FIGS. 2-4) that engages the stop surface 38 of the closure 12 when the closure 12 is threadably coupled to the vial 10. More particularly, the closure 12 may be positioned on the open end 16 of the vial 10 and threadably coupled with the outer thread 24 of the vial 10 until the stop surface 38 of the closure 12 engages the stop surface 50 of the outwardly projecting rib 46. In this way, the cooperation of the stop surface 38 of the closure 12 with the stop surface 50 of the outwardly projecting rib 46 prevents advancement of the closure 12 toward the closed end 18 of the vial 10 upon application of a torquing force onto the closure 12. This cooperation ensures a generally constant and uniform force is applied to the septum 42 around the circumference of the vial rim 17 for each of a plurality of assembled vials 10 and closures 12 to provide an effective compression seal against evaporation. In this way, over-tightening of the closure 12, which may lead to deformation and/or extrusion of the septum 42 from effective sealing contact with the vial rim 17, is prevented. Deformation and/or extrusion of the septum 42 reduces the vapor-tight seal of the assembly and may allow for undesirable evaporation of the solvents within the vial 10. In addition, the generally uniform compression force applied to the septum 42 around the circumference of the vial rim 17 ensures that the septum 42 creates a substantially planar piercing surface 54 at the open end 16 of the vial 10. The planar piercing surface 54 reduces the risk of septum 42 coring and/or bending of a needle (not shown) of a chromatography or autosampler instrument.

In one exemplary embodiment, as shown in FIG. 4, the septum 42 may have an uncompressed height or thickness "$h_1$" of about 1.02 mm. When the closure 12 is fully torqued to the vial 10, as described above, the septum 42 may have a compressed height or thickness "$h_2$" of about 0.57 mm as shown in FIG. 5.

The cooperation of the stop surface 38 of the closure 12 with the stop surface 50 of the outwardly projecting rib 46 also provides a settling surface for the horizontal alignment of the closure 12 on the vial 10 to reduce tilting of the closure 12 relative to the vial 10. In this way, the rim 31 of the closure 12 is aligned in a generally horizontal plane "$P_{H2}$" (FIG. 5) that is coincidental with a generally flattened annular surface 56 (FIGS. 2-5) provided on the outwardly projecting rib 46 opposite the stop surface 50 when the closure 12 is fully torqued to the vial 10 so as to provide a consistent horizontal lifting surface for an arm (not shown) of a robotic handling system commonly used in chromatography or autosampler instruments. In addition, the planar piercing surface 54 provides a more consistent thickness of septum material to be penetrated, which applies less resistant force to the needle.

By preventing further advancement of the closure 12 toward the closed end 18 of the vial 10 in response to over-torquing forces applied to the closure 12, the cooperation of the stop surface 38 of the closure 12 with the stop surface 50 of the outwardly projecting rib 46 ensures that the portion 44 of the neck 22 remains uncovered beneath the rim 31 of the closure 12. The uncovered neck 44 and shoulder portion 26 facilitate alignment and movement of the vial 10 by an arm (not shown) of a robotic handling system (not shown). That is, the arm may grasp the vial 10 between the rim 31 of the closure 12 and the shoulder 26 while a torquing device (not shown) of the robotic handling system applies a torquing force onto the closure 12 so as to couple or remove the closure 12 from the vial 10. Furthermore, the rim 31 of the closure 12 may further facilitate movement of the vial 10 within the robotic handling system, e.g., the arm of the robotic handling system may reside against the rim 31 of the closure 12 and apply an upwardly directed force thereto for lifting the vial 10.

Figure 6:
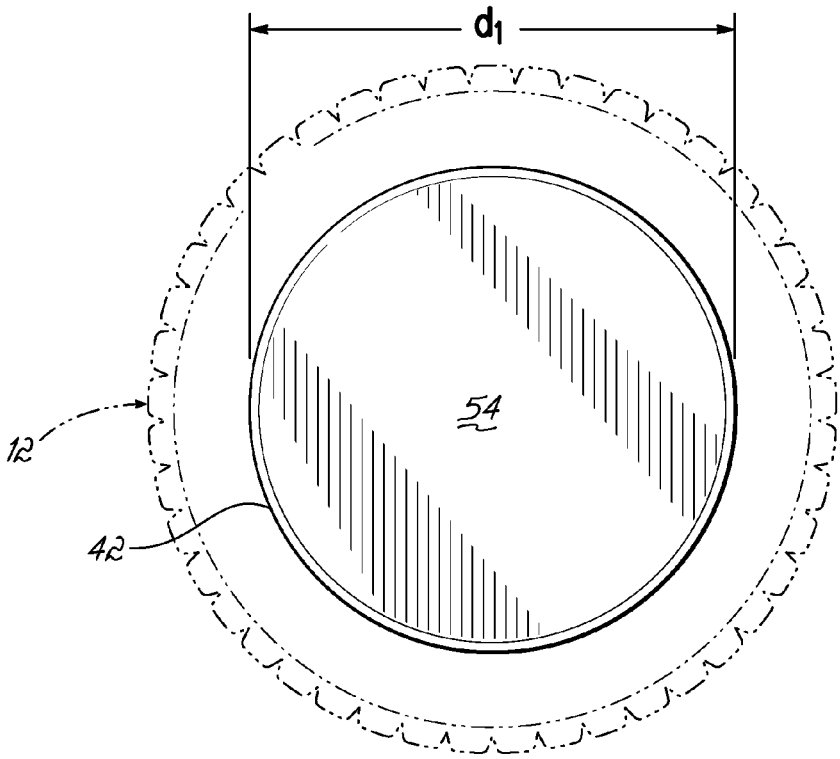
FIG. 6 is a top view of the vial and closure assembly of FIG. 3 showing an uncompressed septum.
Figure 7:
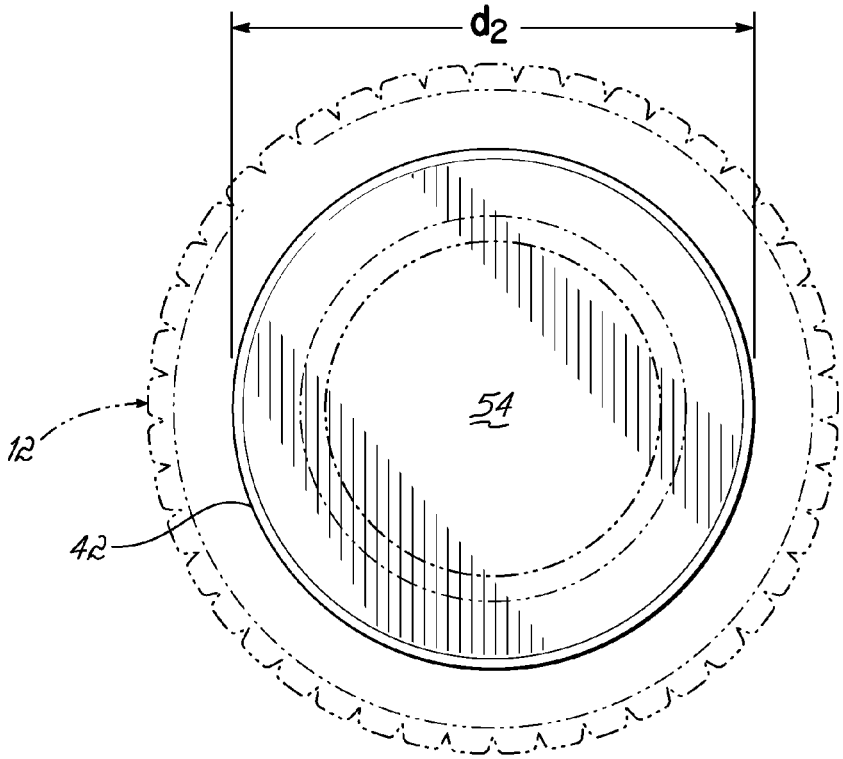
FIG. 7 is a top view of the vial and closure assembly of FIG. 5 showing a compressed septum.

FIGS. 6 and 7 show the vial and closure assembly 14 in un-torqued and torqued positions, respectively. In the un-torqued position, as shown in FIG. 6, the septum 42 has a diameter "$d_1$". In the torqued position, as shown in FIG. 7, the stop surface 38 of the closure 12 engages the outwardly projecting rib 46, and the septum 42 is axially expanded to an increased diameter "$d_2$" to form an essentially fluid and vapor tight seal between the vial 10 and the top wall of the closure 12.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicants' invention.

What is claimed is:

1. A vial and closure assembly, comprising:

a vial having an open end defined by a vial rim and at least one outer thread located proximate the open end of the vial; and a closure configured to be received by the open end of the vial and comprising:

a top wall;

a skirt wall having an inner surface and depending from the top wall;

an inner thread provided on the inner surface of the skirt wall;

an opening formed through the top wall;

a septum pocket provided in the top wall and configured to receive a septum positioned within the septum pocket; and a protrusion depending from the top wall and extending into the septum pocket, the protrusion having an inner surface and an outer surface that are asymmetric relative to a vertical plane extending through a peak of the protrusion, wherein, when the closure is threadably coupled to the vial, the protrusion is configured to engage the septum so that the septum creates an essentially vapor-tight seal with the vial rim.

2. The vial and closure assembly of claim 1, further comprising:

a septum positioned within the septum pocket and being at least partially exposed through the opening.

3. The vial and closure assembly of claim 2, wherein the protrusion is further configured to stretch the septum relative to the vial rim to secure the septum to the vial rim.

4. The vial and closure assembly of claim 1, wherein the vial further comprises an outwardly projecting rib located adjacent the at least one outer thread provided on the vial with the at least one outer thread being located between the outwardly projecting rib and the vial rim, the outwardly projecting rib and the at least one outer thread having respective first and second maximum width dimensions extending outwardly from an outer surface of the vial, with the first maximum width dimension being greater than the second maximum width dimension, and the closure further comprises a stop surface provided on the inner surface of the skirt wall, with the inner thread being located between the stop surface and the top wall of the closure, wherein the stop surface is configured to engage the outwardly projecting rib when the closure is threadably coupled to the vial so as to prevent advancement of the closure upon application of a torquing force onto the closure.

5. The vial and closure assembly of claim 4, wherein the outwardly projecting rib provided on the vial and the stop surface provided on the closure are configured to cooperate when the closure is threadably coupled to the vial so that a generally constant force is applied to the septum around the circumference of the vial rim.

6. The vial and closure assembly of claim 1, wherein the open end of the vial further comprises a neck having the at least one outer thread located on the neck.

7. The vial and closure assembly of claim 4, wherein the outwardly projecting rib is continuous about the circumference of the vial.

8. The vial and closure assembly of claim 4, wherein the skirt wall terminates in a rim located opposite the top wall of the closure, and further wherein the outwardly projecting rib provided on the vial and the stop surface provided on the closure are configured to cooperate when the closure is threadably coupled to the vial so that the rim of the skirt wall is aligned generally in a horizontal plane.

9. The vial and closure assembly of claim 1, wherein the protrusion comprises a plurality of discrete, circumferentially spaced lugs, spaced radially outwardly from the opening.

10. The vial and closure assembly of claim 1, wherein the protrusion comprises a continuous, circumferential rib spaced radially outwardly from the opening.

11. A closure for use with a vial having an open end defined by a vial rim at least one outer thread and an outwardly projecting rib, the closure being configured to be received by the open end of the vial and comprising:

a top wall;

a skirt wall having an inner surface and depending from the top wall;

an inner thread provided the inner surface of the skirt wall; and an opening formed through the top wall;

a septum pocket provided in the top wall and configured to receive a septum positioned within the septum pocket; and a protrusion depending from the top wall and extending into the septum pocket, the protrusion having an inner surface and an outer surface that are asymmetric relative to a vertical plane extending through a peak of the protrusion, wherein, when the closure is threadably coupled to the vial, the protrusion is configured to engage the septum so that the septum creates an essentially vapor-tight seal with the vial rim.

12. The vial and closure assembly of claim 10, further comprising:

a septum provided within the septum pocket and being at least partially exposed through the opening.

13. The vial and closure assembly of claim 12, wherein the protrusion is further configured to stretch the septum relative to the vial rim to secure the septum to the vial rim.

14. The closure of claim 10, wherein the vial includes at least one outer thread being located between the outwardly projecting rib and the vial rim, the outwardly projecting rib and the at least one outer thread having respective first and second maximum width dimensions extending outwardly from an outer surface of the vial, with the first maximum width dimension being greater than the second maximum width dimension, and the closure further comprises:

a stop surface provided on the inner surface of the skirt wall, with the inner thread being located between the stop surface and the top wall of the closure, wherein the stop surface is configured to engage the outwardly projecting rib when the closure is threadably coupled to the vial so as to prevent advancement of the closure upon application of a torquing force onto the closure.

15. The closure of claim 10, wherein the stop surface comprises a plurality of discrete, circumferentially spaced ledges.

* * * * *

UNITED STATES PATENT AND TRADEMARK OFFICE

CERTIFICATE OF CORRECTION

PATENT NO. : 8,652,423 B2
APPLICATION NO. : 13/562654
DATED : February 18, 2014
INVENTOR(S) : Leemen Loy Shick It is certified that error appears in the above-identified patent and that said Letters Patent is hereby corrected as shown below:

In the Specification:

In column 4, line 64, change "are full assembled." to --are fully assembled.--.

In column 7, line 7-8, change "the spirit or scope of applicants' invention." to --the spirit or scope of applicant's invention.--.

In the Claims:

In claim 11, column 8, line 19, change "by a vial rim at least one outer thread" to --by a vial rim, at least one outer thread--.

Signed and Sealed this
Twenty-seventh Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,652,423 B2
APPLICATION NO. : 13/562654
DATED : February 18, 2014
INVENTOR(S) : Leemen Loy Shick It is certified that error appears in the above-identified patent and that said Letters Patent is hereby corrected as shown below:

In the Claims:

In claim 12, column 8, line 40, change "The vial and closure assembly of claim 10, further comprising:" to --The closure of claim 11, further comprising:--.

In claim 13, column 8, line 44, change "The vial and closure assembly of claim 12," to --The closure of claim 12,--.

In claim 14, column 8, line 47, change "The closure of claim 10," to --The closure of claim 11,--.

In claim 15, column 8, line 63, change "The closure of claim 10," to --The closure of claim 14,--.

Signed and Sealed this
Eighth Day of September, 2015

Michelle K. Lee

Michelle K. Lee
*Director of the United States Patent and Trademark Office*